US007882722B2

(12) United States Patent
Lefavour et al.

(10) Patent No.: US 7,882,722 B2
(45) Date of Patent: Feb. 8, 2011

(54) JAW ASSEMBLY

(75) Inventors: John D. Lefavour, Litchfield, NH (US); Jennifer M. Peterson, Manchester, NH (US); Thomas R. Faucher, Manchester, NH (US)

(73) Assignee: Hubbell Incorporated, Shelton, CT (US)

( * ) Notice: Subject to any disclaimer, the term of this patent is extended or adjusted under 35 U.S.C. 154(b) by 600 days.

(21) Appl. No.: 11/888,971

(22) Filed: Aug. 3, 2007

(65) Prior Publication Data

US 2009/0031779 A1 Feb. 5, 2009

(51) Int. Cl.
*B21D 37/12* (2006.01)

(52) U.S. Cl. ..... 72/416; 72/482.92; 72/481.1

(58) Field of Classification Search ..... 72/416, 72/412, 414, 409.08, 409.09, 409.01, 409.1, 72/482.92, 481.1, 409.19, 478; 81/416; 30/244, 30/250, 252

See application file for complete search history.

(56) References Cited

U.S. PATENT DOCUMENTS

| | | | | |
|---|---|---|---|---|
| 1,999,057 | A | 4/1935 | Peterson et al. | 78/38 |
| 2,396,562 | A | 3/1946 | Forss | 140/55 |
| 2,684,003 | A | 7/1954 | Klingler | 81/15 |
| 2,814,222 | A | 11/1957 | Sanders | 81/15 |
| 3,680,212 | A | 8/1972 | Rozmus | 30/266 |
| 4,198,749 | A | 4/1980 | Nordin | 30/192 |
| 4,480,460 | A | 11/1984 | Bush et al. | 72/410 |
| 5,138,864 | A | 8/1992 | Tarpill | 72/410 |
| 5,335,531 | A | 8/1994 | Mann et al. | 72/416 |
| 5,987,750 | A | 11/1999 | Tally | 30/92 |
| 6,044,686 | A | 4/2000 | Dischler | 72/402 |
| 6,092,290 | A | 7/2000 | Vogelsanger | 30/228 |
| 6,154,964 | A | 12/2000 | Tally | 30/92 |
| 6,164,106 | A | 12/2000 | Nghiem et al. | 72/20.1 |
| 6,772,618 | B2 | 8/2004 | Frenken | 72/409.16 |
| 7,107,812 | B1 | 9/2006 | Patton et al. | 72/392 |
| 7,216,523 | B2 | 5/2007 | Frenken | 72/416 |
| 2003/0046973 | A1 | 3/2003 | Hamm et al. | 72/452.8 |
| 2005/0034571 | A1 * | 2/2005 | Hwang | 81/176.3 |
| 2006/0000072 | A1 * | 1/2006 | Frenken | 29/237 |

FOREIGN PATENT DOCUMENTS

| | | | |
|---|---|---|---|
| KR | 20020060460 | A | 7/2002 |

* cited by examiner

*Primary Examiner*—Debra M Sullivan
(74) *Attorney, Agent, or Firm*—Harrington & Smith

(57) ABSTRACT

A jaw assembly including a first jaw, a second jaw, and a pivot pin. The first jaw has two spaced first ears having pivot pin holes through the first ears. The second jaw has two spaced second ears having a pivot pin holes through the second ears. The pivot pin is located in the pivot pin holes to pivotably mount the first and second jaws to each other. The pivot sections include a guide surface configured to guide alignment of the ears relative to each other to thereby align the pivot pin holes with each other. The jaws each include a rear end with a roller contact surface configured to be moved apart by rollers of a roller assembly of a tool. The rear ends each include a concave surface configured to locate one of the rollers therein.

28 Claims, 10 Drawing Sheets

JAW ASSEMBLY

BACKGROUND OF THE INVENTION

1. Field of the Invention

The invention relates to a jaw assembly and, more particularly, to a jaw assembly for a tool.

2. Brief Description of Prior Developments

U.S. Pat. No. 7,216,523 B2 discloses a pair of jaws for a tool. The jaws are moved by rollers pressing against rear ends of the jaws. A problem exists when attempting to assemble the jaws of a tool to a frame of the tool with a single pivot pin, in that alignment of pivot pin holes in the jaws and the frame of the tool and insertion of the single pivot pin is difficult. There is a desire to provide a system which makes insertion of a single pivot pin into the pivot pin holes faster and easier.

SUMMARY OF THE INVENTION

In accordance with one aspect of the invention, a jaw assembly is provided including a first jaw, a second jaw, and a pivot pin. The first jaw has two spaced first ears having pivot pin holes through the first ears. The second jaw has two spaced second ears having a pivot pin holes through the second ears. The pivot pin is located in the pivot pin holes to pivotably mount the first and second jaws to each other. The pivot sections include a guide surface configured to guide alignment of the ears relative to each other to thereby align the pivot pin holes with each other. The jaws each include a rear end with a roller contact surface configured to be moved apart by rollers of a roller assembly of a tool. The rear ends each include a concave surface configured to locate one of the rollers therein.

In accordance with another aspect of the invention, a jaw assembly is provided comprising a pair of jaws pivotably connected to each other, wherein the jaws comprise rear ends with roller contact surfaces configured to be moved apart by rollers of a roller assembly of a tool, wherein the rear ends each comprise a concave surface configured to locate one of the rollers therein at an open jaw position of the jaws.

In accordance with another aspect of the invention, a jaw assembly is provided comprising a first jaw having a first pivot section comprising two spaced first ears having pivot pin holes through the ears; a second jaw having a second pivot section comprising at least one second ear having a pivot pin hole through the at least one second ear; and a pivot pin located in the pivot pin holes to pivotably mount the first and second jaws to each other. At least one of the pivot sections comprises a guide surface configured to guide alignment of the ears relative to each other to thereby align the pivot pin holes with each other.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
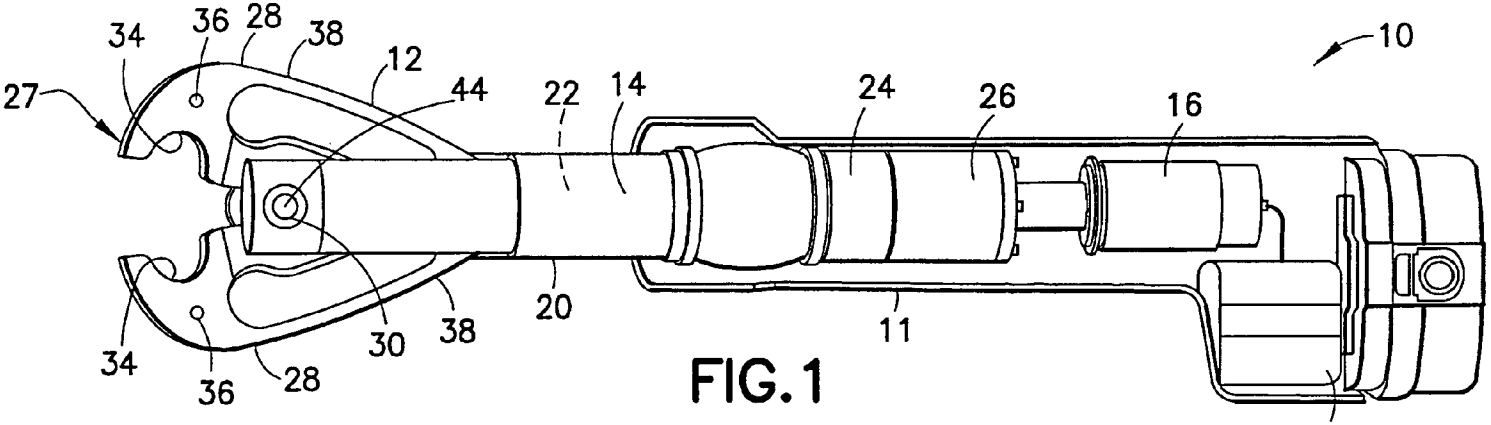
FIG. 1 is a side view with a cut away section of a tool comprising features of the invention.

Referring to FIG. 1, there is a shown a battery operated hydraulic tool 10 adapted to crimp an electrical connector onto an electrical conductor. The tool 10 generally comprises a main section 11 forming a drive section and a working head 12. In this example the drive section comprises a hydraulic drive system 14, a motor 16 and a battery 18. The hydraulic drive system 14 comprises a frame 20 with a hydraulic fluid conduit system, a ram 22 movably connected to the frame 20 and a pump 24. The pump 24 is connected to the motor 16 by a transmission 26. Movement of the ram 22 by the hydraulic drive system is adapted to pivotably move the set of jaws 27 of the working head 12 in a general scissors fashion.

Although the invention is described with reference to a battery operated hydraulic tool, features of the invention could be used in a manual hand operated tool, such as described in U.S. Pat. No. 2,814,222 for example. Although the invention will be described with reference to the exemplary embodiments shown in the drawings, it should be understood that the invention can be embodied in many alternate forms of embodiments. In addition, any suitable size, shape or type of elements or materials could be used.

The set of jaws 27 includes two jaw sections 28 pivotably connected to each other at a connection 30. Each jaw section 28 generally comprises a jaw 38 and a removable crimp die (not shown). However, one or both of the jaw sections might not comprise a removable crimp die. The front ends of the jaws 38 are adapted to removably receive the crimp dies (not shown) in receiving pockets 34 and on mounting pins 36. FIG. 1 shows the jaws 38 without the crimp dies attached.

Figure 2:
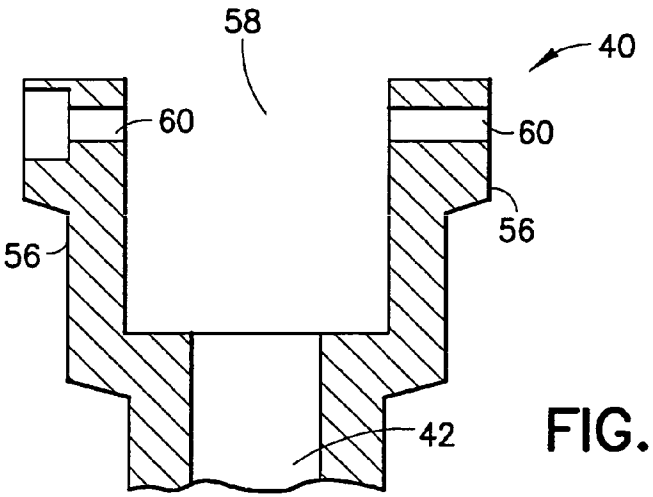
FIG. 2 is a cross sectional view of the front end of the working head frame shown in FIG. 1.

Referring also to FIG. 2, the working head 12 includes a frame 40. The rear end of the frame 40 is stationarily attached to the frame 20. However, in an alternate embodiment, the frame 40 could be rotatably connected to the frame 20. The frame 40 has a rear end with a channel 42 which is configured to allow the ram 22 to extend and retract in the channel. In one type of embodiment, the rear end of the frame 40 could form the front end of the ram cylinder which receives hydraulic fluid behind the rear end of the ram.

Figure 3:
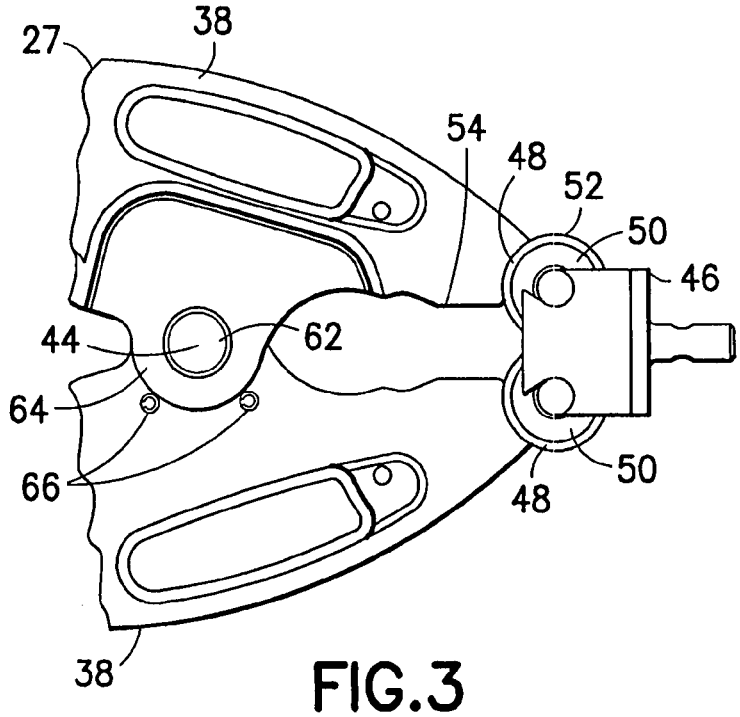
FIG. 3 is a partial side view of components of the working head shown in FIG. 1.
Figure 4:
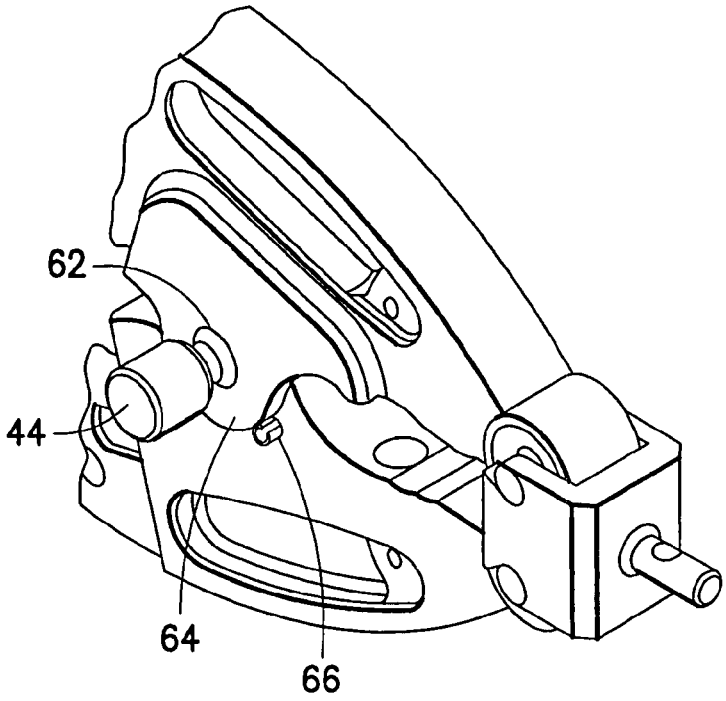
FIG. 4 is a perspective view of the components shown in FIG. 3.
Figure 5:
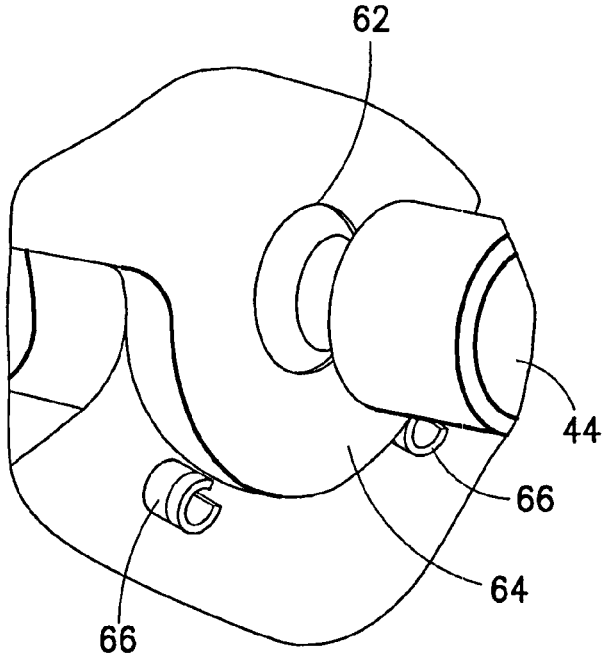
FIG. 5 is a perspective view of a portion of the components shown in FIG. 4 from another direction.

The frame 40 is configured to allow removable mounting of the set of jaws 27 at the front end of the frame 40. More specifically, in this embodiment the set of jaws 27 is attached at the connection 30 by a release pin 44. FIGS. 3-5 show the pin 44 pivotably connecting the set of jaws 27 to each other without showing the frame 40. FIGS. 3 and 4 also show a roller assembly 46 which is configured to be attached to the front end of the ram 22. Each jaw 38 has a rear end with a surface 48 adapted to be contacted by the rollers 50 of the roller assembly 46. Each surface 48 has a rear concave surface 52 and a front cam or ramp surface 54. The rear concave surface 52 is sized and shaped to substantially mate with a portion of the outer surface of one of the rollers 50. For example, the rollers might have a diameter of about 0.88 inch and the curvature of the rear concave surface 52 could be 0.88 inch in diameter. This is only an example and should not be considered as limiting the invention.

As the ram 22 pushes the roller assembly 46 forward, the rollers 50 are able to roll out of the rear concave surface 52 and onto the ramp surfaces 54. This results in the rear ends of the jaws 38 separating and the front ends of the jaws closing; the jaws 38 pivoting on the pin 44. When the ram is retracted, a spring (not shown) is able to return the jaws 38 back to the home open position shown in FIG. 1.

As seen in FIG. 2, the frame 40 has two arms 56 with a jaw receiving space and roller assembly locating area 58 therebetween. Each arm 56 has a pin mounting hole 60. The left side hole 60 has a counter bored area for easier grasping of the pin 44 during removal. In order to mount the set of jaws 27 to the frame 40, the jaws 38 are inserted into the area 58, and the pin 44 is then inserted through the holes 60 and the pivot holes 62 of the jaws 38. This securely and pivotably mounts the jaws 38 to each other and to the frame 40. However, the pin 44 can be removed to remove the set of jaws 27 and replace them with another set of jaws.

One potential problem with this type of assembly is that during insertion of the pin 44, the holes 60 and the holes 62 of the jaws 38 must be substantially perfectly aligned or the pin 44 will not be able to be inserted. The tolerances of the holes 60, 62 are simply too small to allow for any significant misalignment. This could make insertion of the pin very difficult. To alleviate this problem, the set of jaws 27 has been provided with a system for aligning the holes 62 of the two jaws 38 with each other. Thus, the user merely needs to align the holes 60 with the already aligned set of holes 62 of the two jaws 38. This is much easier than attempting to align three or more sets of holes at the same time.

In this embodiment, the jaws 38 each comprise two ears 64. One of the pivot holes 62 is provided in each ear. Thus, the ears form pivot sections for the jaws. One of the ears 64 on each jaw 38 comprises a guide surface on an exterior facing lateral side. The guide surfaces are configured to guide alignment of the ears relative to each other to thereby align the pivot holes 60, 62 with each other. In the embodiment shown, each guide surface comprises a plurality of guide pins 66 on the exterior facing lateral side of the ear. A top/bottom surface of one of the ears from the opposite jaw is able to sit against the guide pins 66 to thereby seat the jaws 38 relative to each other and align the four holes 62 of the four ears 64. This is done while the spring (not shown) is attempting to push the jaws apart because of contact of the rear of the jaws 38 with the roller assembly 46. In the embodiment shown in FIG. 1, the jaws 38 are identical to each other. However, in alternate embodiments the jaws could be different.

Figure 6:
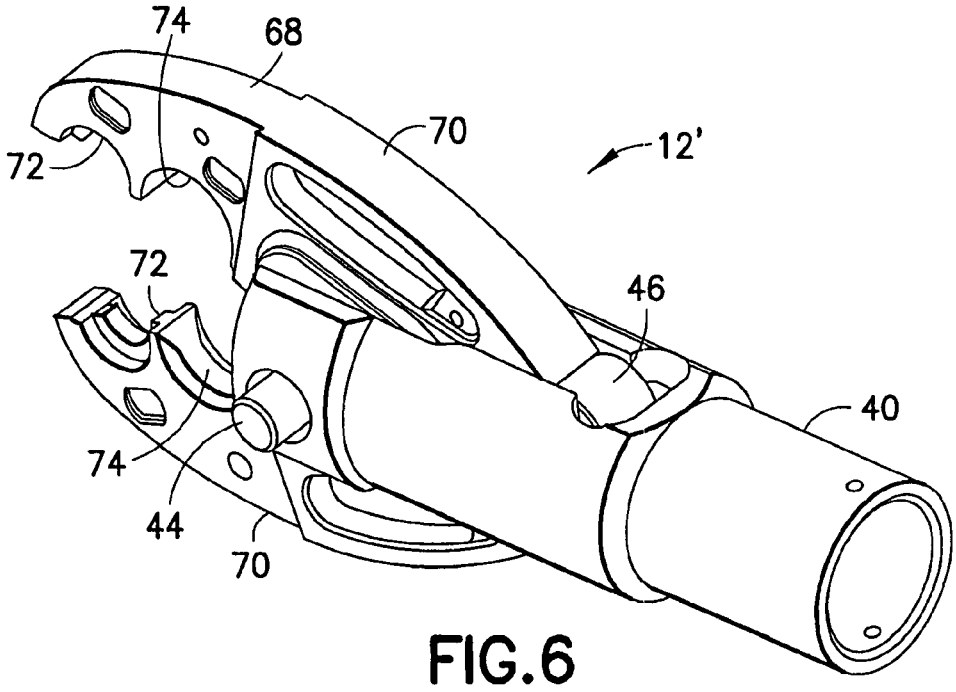
FIG. 6 is a perspective view of an alternate embodiment of the present invention.

Referring also to FIG. 6, an alternate embodiment of the working head is shown. The working head 12' comprises the frame 40 and a different second set of jaws 68. In this embodiment the set of jaws 68 comprise two identical jaws 70 which are substantially identical to the jaws 38 except that the jaws 70 each have two receiving pockets 72, 74. The receiving pockets 72, 74 have different sizes to be able to crimp different size connectors onto different size conductors. In this embodiment, the rear pair of receiving pockets 74 can be adapted to receive removable crimping dies, and the front pair of receiving pockets 72 can be adapted to crimp connectors without crimping dies (die-less). In an alternate embodiment, both sets of receiving pockets 72 and 74 could be adapted to receive removable crimping dies or alternatively be die-less crimping areas which do not receive removable crimping dies.

Figure 7:
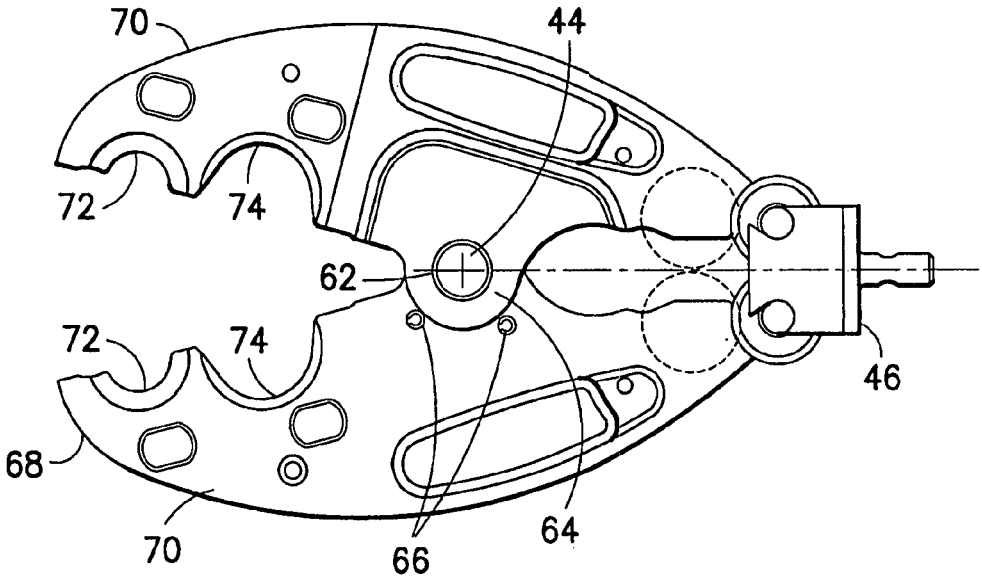
FIG. 7 is a side view of some of the components of the working head shown in FIG. 6.
Figure 8:
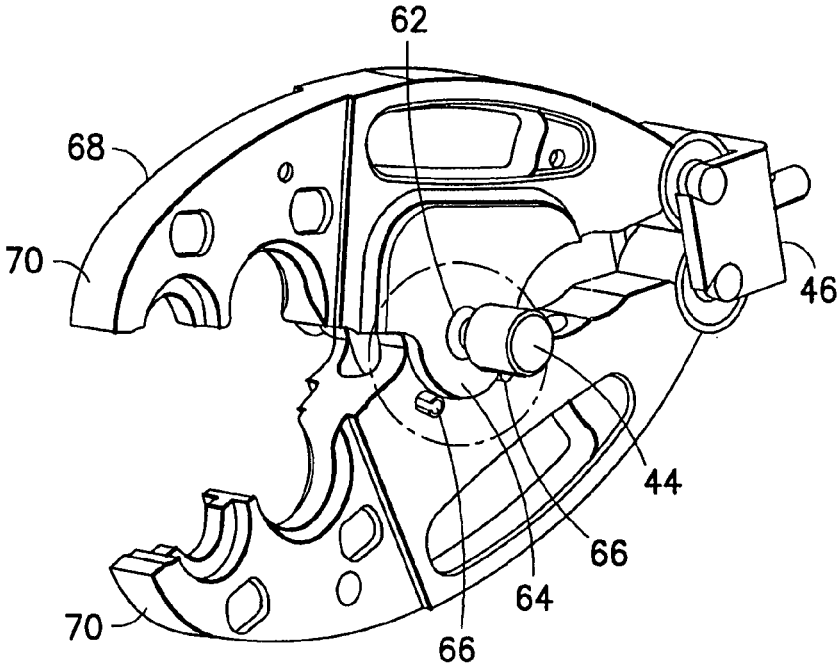
FIG. 8 is a perspective view of the components shown in FIG. 7.
Figure 9A:
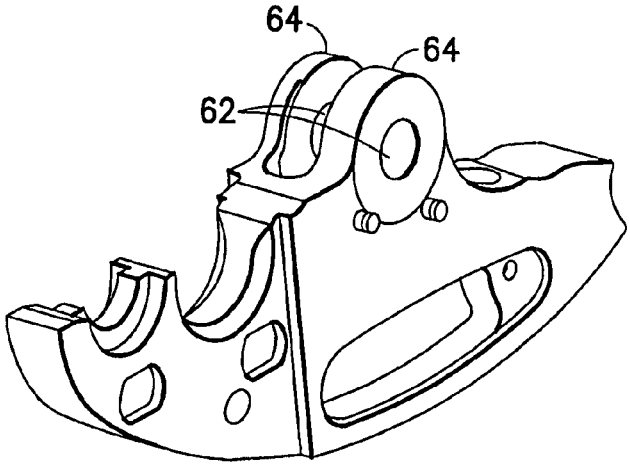
FIGS. 9A-9G are various views of one of the jaws shown in FIGS. 6-8.
Figure 9B:
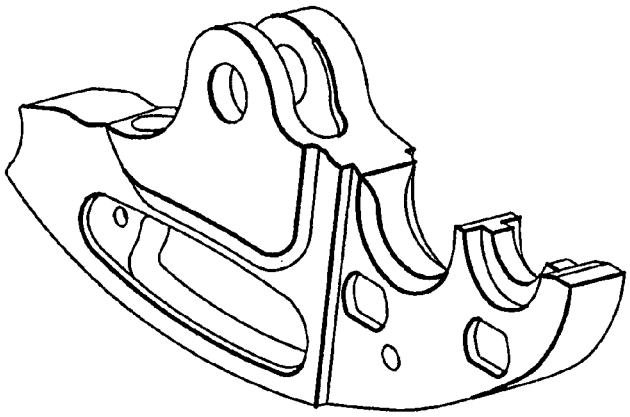
Figure 9C:
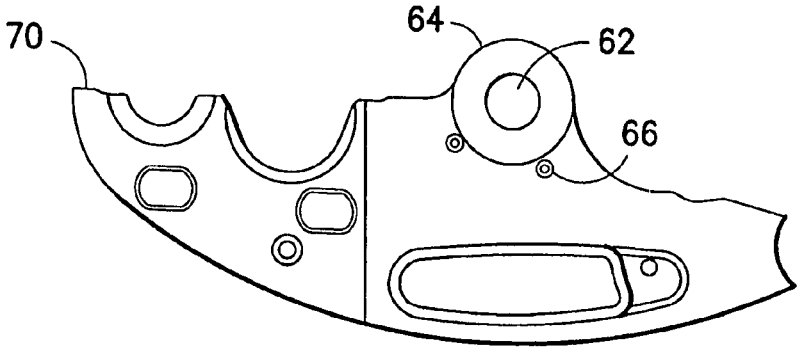
Figure 9D:
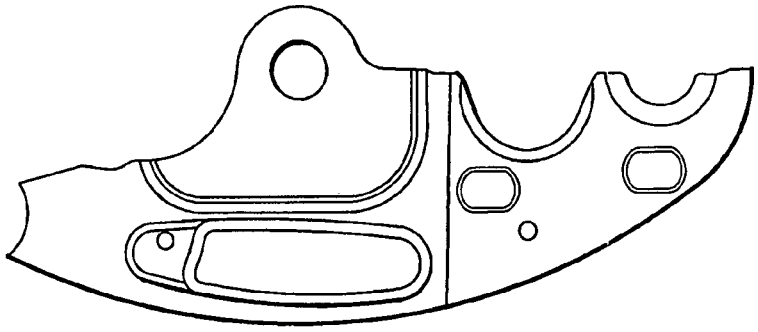
Figure 9E:
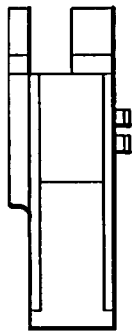
Figure 9F:
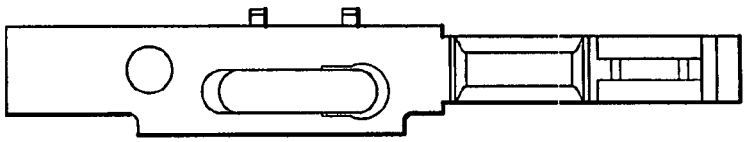
Figure 9G:
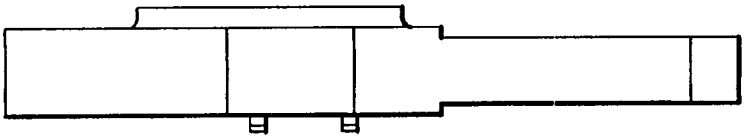

Referring also to FIGS. 7-8, the set of jaws 68 is shown connected by the pin 44 without showing the frame 40, and FIGS. 9A-9G show one of the jaws 70 in various views. Similar to the first embodiment, the jaws 70 each comprise two ears 64 with one of the pivot holes 62 in each ear. Thus, the ears form pivot sections for the jaws. One of the ears 64 on each jaw 70 comprises a guide surface on an exterior facing lateral side configured to guide alignment of the ears relative to each other to thereby align the pivot holes 62 with each other. In the embodiment shown, the guide surface comprises a plurality of guide pins 66 on the exterior facing lateral side of the ear. A top/bottom surface of one of the ears from the opposite jaw is able to sit against the guide pins 66 to thereby seat the jaws 70 relative to each other and align the four holes 62 of the four ears 64. This is done while the spring (not shown) is attempting to push the jaws apart. The four aligned holes 62 can then be relatively easily aligned with the holes 60 of the frame 40, and the pin 44 can be inserted.

Figure 10:
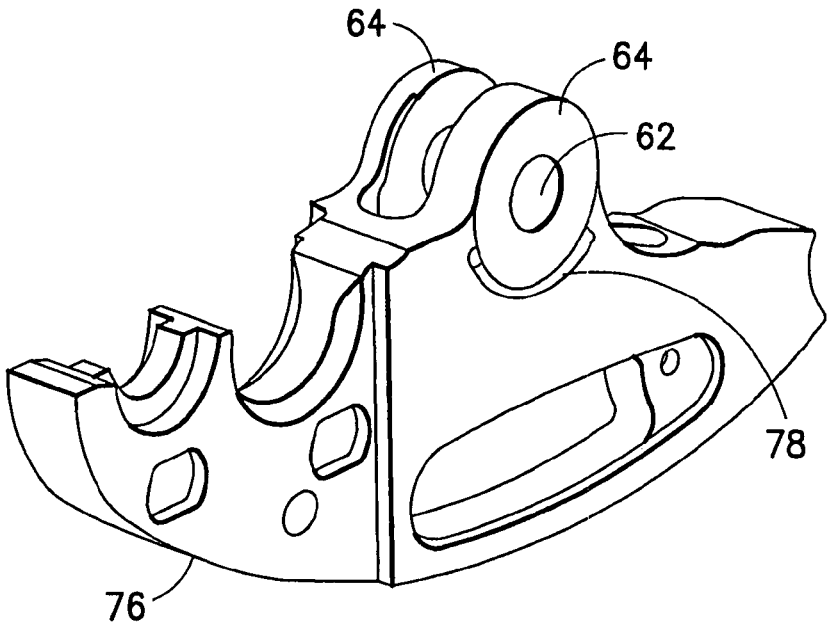
FIG. 10 is a perspective view of an alternate embodiment of the jaw shown in FIGS. 9A-9G.
Figure 11:
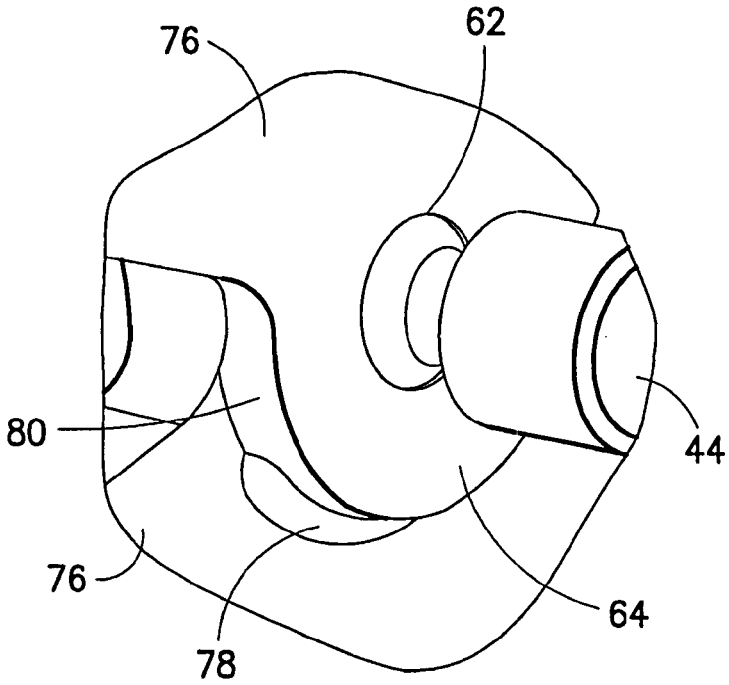
FIG. 11 is a partial perspective view of the jaw shown in FIG. 10 attached to an identical mating jaw.

Referring also to FIGS. 10-11, another alternate embodiment is shown. In this embodiment the jaws 76 are identical to the jaws 70 except that the guide surface on the exterior facing lateral side of each jaw comprises a curved guide rib 78. The rib 78 projects laterally outward from the side of the jaw 76 and forms a surface configured to support the surface 80 of the ear of the opposite jaw 76 thereon. The pair of jaws 76 thus has two of the guide ribs 78 (one on each side of the jaw assembly) that seat the jaws 70 relative to each other and align the four holes 62 of the four ears 64. The jaws 76 can rotate relative to each other on the guide ribs 78 while still keeping the four holes 62 aligned.

Figure 12:
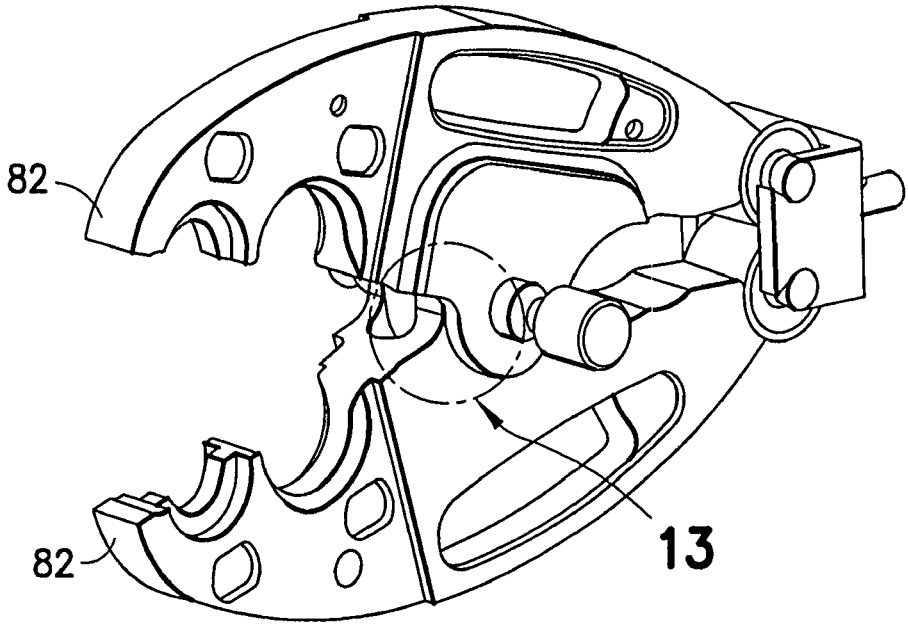
FIG. 12 is a perspective view of an alternate embodiment of the jaw shown in FIGS. 9A-9G.
Figure 13:
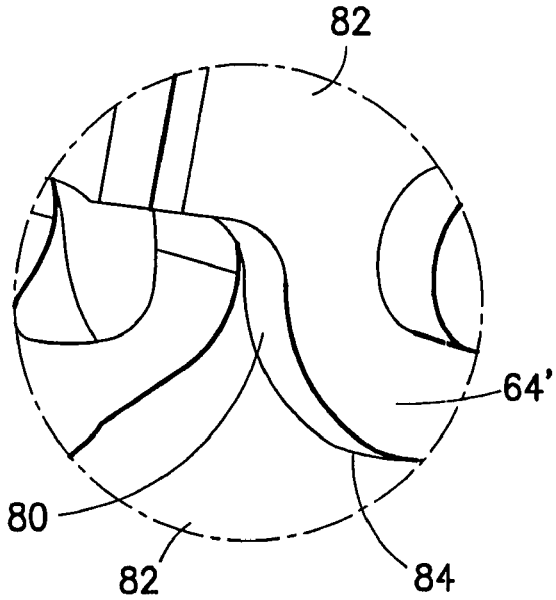
FIG. 13 is a partial perspective view of the jaw shown in FIG. 12 attached to an identical mating jaw.
Figure 14:
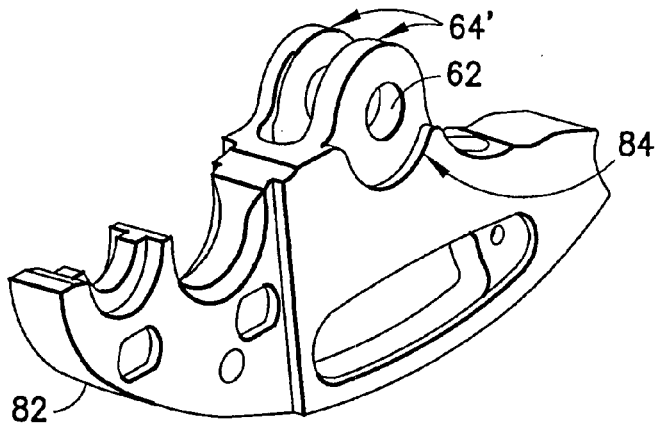
FIG. 14 is a perspective view of one of the jaws shown in FIGS. 12-13.

Referring also to FIGS. 12-14, another alternate embodiment of the invention is shown. In this embodiment the jaws 82 are identical to the jaws 70 except that the ears 64' of each jaw have the same thickness (unlike the jaws 70 which have ears of unequal thickness), and that the guide surfaces comprise machined grooves 84 into the jaws at the base of one of the ears 64' for each jaw; adjacent one exterior lateral side of the jaw. The machined surfaces 84 forms a surface configured to support the surface 80 of the ear 64' of the opposite jaw 82 thereon. The pair of jaws 82 thus has two of the guide machined surfaces 84 (one on each side of the jaw assembly) that seat the jaws 82 relative to each other and align the four holes 62 of the four ears 64'. The jaws 82 can rotate relative to each other on the machined surfaces 84 while still keeping the four holes 62 aligned.

Figure 16A:
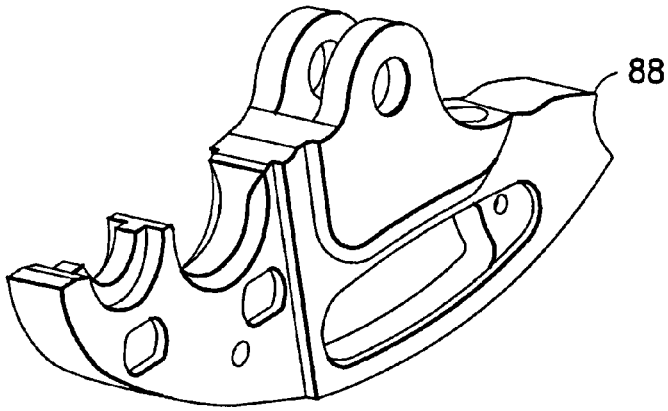
FIGS. 16A and 16B are perspective views of the jaws shown in FIG. 15.
Figure 16B:
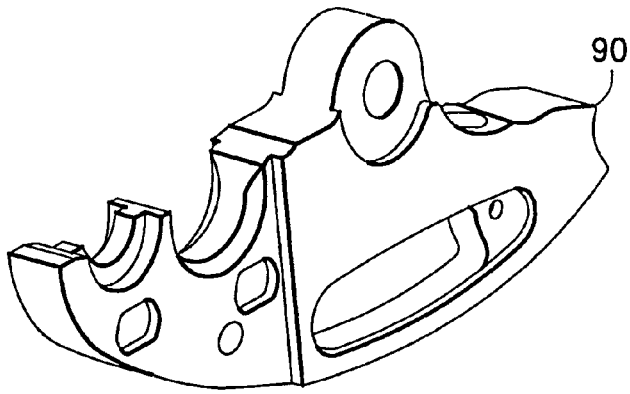
Figure 15:
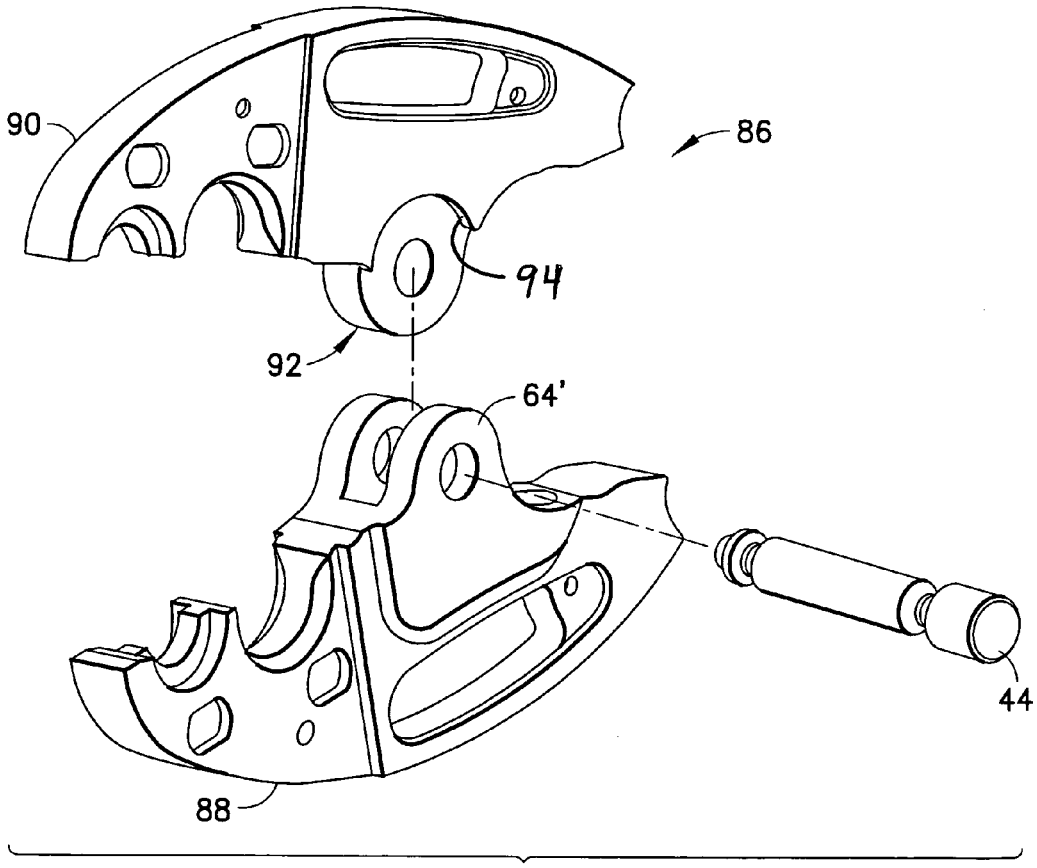
FIG. 15 is an exploded perspective view of an alternate embodiment of the jaw assembly showing two different jaws.

Referring also to FIGS. 15-16B, another alternate embodiment of the invention is shown. In this embodiment the set of jaws 86 comprise a first jaw 88 and a different second jaw 90. The first jaw 88 is identical to the jaws 82 except that the jaw 88 does not have the machined surface 84. The second jaw 90 is substantially identical to the first jaw 88 except that it has a different pivoting section. In this embodiment the pivoting section of the second jaw 90 has a single ear 92 and two guide surfaces on opposite sides of the ear 92. In this embodiment the two guide surfaces comprise curved machined surfaces 94. The surfaces 94 are adapted to receive the ends of the ears 64' of the first jaw 88. The spacing between the ears 64' forms a gap which is sized and shaped to receive the ear 92. This embodiment illustrates that the jaws of the jaw assembly could be different from each other, and that only one of the jaw might be provided with a formed or machines additional alignment guiding surface for the other jaw.

Features of the present invention could be used with a jaw set that may be used for crimping, cutting or swaging a work piece such as an electrical connector, conductor, tube, etc.

The opening at the front section of the jaws should be maintained in order to fit the largest conductor/connector combinations. This opening is controlled via the rearward section of the jaws which employs concave surfaces which meet with rollers. The concave surface of each jaw is mated with a roller which controls the jaw opening at the front section of the jaws and also maintains jaw assembly orientation within the crimp tool. As a result, the distance from the jaw pivot hole to the center radius of the concave surface is sized accordingly to maintain the desired jaw opening at the front section when the rollers are fully retracted.

The concave surface prevents the jaws assembly from rotating within the crimp tool relative to the axis of the crimp tool. As an example, where the length of the jaw from the pivot point to rear jaw tip is 1.88 in., the rollers surface engages the concave surface of the jaw and prevents the jaw assembly from rotating as a result of the engagement. The engagement in the example is (2.0–0.88/2)–1.88=–0.32 in. This concave feature also insurers that when the jaws are installed into the crimped tool body they are aligned properly relative to the tool body. If they are not, then the pull release pin will not insert or the jaws will be grossly out of position.

Another feature added to the jaws is to facilitate the jaw pull release pin alignment. This feature eases installation of the jaw assembly into the tool body. This feature can be employed by adding guide pins, a guide rib or a machine surface for example. Various configurations are illustrated. However, the principle of operation and function is the same for all the illustrations.

In order to assemble the jaws into the tool frame, the pivot holes in the jaw must align with the axis of the pull released pin. The guide pin, guide rib or machined surface force the alignment of the two jaws relative to each other, and the concave surface at the rear cross-section (when mated with the rollers) space the jaw assembly to align the jaw pivot holes with the holes in the tool frame (i.e. in the direction axially to the tool body). As a result, the user only needs to position the jaws in the vertical direction relative to the holes in the tool frame.

It should be understood that the foregoing description is only illustrative of the invention. Various alternatives and modifications can be devised by those skilled in the art without departing from the invention. For example, features recited in the various dependent claims could be combined with each other in any suitable combination(s). Accordingly, the invention is intended to embrace all such alternatives, modifications and variances which fall within the scope of the appended claims.

What is claimed is:

1. A jaw assembly comprising a pair of jaws pivotably connected to each other, wherein the jaws comprise rear ends with roller contact surfaces configured to be moved apart by rollers of a roller assembly of a hydraulic crimping tool, wherein the rear ends each comprise a concave surface configured to locate one of the rollers therein at an open jaw position of the jaws, wherein the jaws comprise ears with pivot holes, and wherein at least one of the ears comprises a laterally outward extending guide surface on an exterior facing side configured to guide alignment of the ears relative to each other to thereby align the pivot holes with each other.

2. A jaw assembly as in claim 1 wherein the roller contact surfaces comprise cam surfaces located in front of the concave surfaces.

3. A jaw assembly as in claim 1 wherein the jaw assembly further comprising a pivot pin located in the pivot holes and pivotably connecting the jaws to each other.

4. A jaw assembly as in claim 1 wherein the jaw assembly comprises means for preventing rotation of the jaw assembly on a tool body, wherein the means for preventing rotation comprises the concave surfaces.

5. A jaw assembly as in claim 1 wherein the jaw assembly comprises means for removably mounting the jaw assembly to a tool body, wherein the means for removably mounting comprises a pivot pin located in the pivot holes of the jaws and pivotably connecting the jaws to each other.

6. A hydraulic crimping tool comprising:

a main section having a frame and a hydraulic drive section; and a working head comprising a jaw assembly as in claim 1 connected to the frame.

7. A hydraulic crimping tool as in claim 6 wherein the hydraulic drive section comprises a ram with the roller assembly mounted to a front end of the ram.

8. A hydraulic crimping tool as in claim 7 wherein the jaw assembly comprises means for removably mounting the jaw assembly to frame, and wherein the means for removably mounting comprises a pivot pin located in the pivot holes of the jaws and pivotably connecting the jaws to each other.

9. A hydraulic crimping tool as in claim 8 wherein the roller contact surfaces comprise cam surfaces located in front of the concave surfaces.

10. A hydraulic crimping tool as in claim 9 wherein the jaws are substantially identical to each other.

11. A hydraulic crimping tool as in claim 10 wherein the jaw assembly comprises means for preventing rotation of the jaw assembly on the frame, wherein the means for preventing rotation comprises the concave surfaces.

12. A jaw assembly comprising:

a first jaw having a first pivot section comprising two spaced first ears having pivot pin holes through the ears;

a second jaw having a second pivot section comprising at least one second ear having a pivot pin hole through the at least one second ear; and a pivot pin located in the pivot pin holes to pivotably mount the first and second jaws to each other, wherein at least one of the pivot sections comprises a guide surface configured to directly contact a laterally outward extending surface of one of the other pivot sections to guide alignment of the ears relative to each other before full insertion of the pivot pin to thereby align the pivot pin holes with each other, wherein the jaws each comprise a rear end with a roller contact surface configured to be moved apart by rollers of a roller assembly of a hydraulic crimping tool, wherein the rear ends each comprise a concave surface configured to locate one of the rollers therein at an open jaw position of the jaws.

13. A jaw assembly as in claim 12 wherein the guide surface comprises a plurality of guide pins on an exterior facing lateral side of the at least one pivot section.

14. A jaw assembly as in claim 12 wherein the guide surface comprises a curved guide rib on an exterior facing lateral side of the at least one pivot section.

15. A jaw assembly as in claim 12 wherein the guide surface comprises a curved machined surface pocket adjacent an exterior facing lateral side of the at least one pivot section.

16. A jaw assembly as in claim 12 wherein the first and second jaws are substantially identical.

17. A jaw assembly as in claim 12 wherein the guide surface extends from an exterior side of the second jaw.

18. A jaw assembly as in claim 12 wherein the second jaw comprises two of the second ears.

19. A hydraulic crimping tool comprising:

a main section having a frame and a hydraulic drive section; and a working head comprising a jaw assembly as in claim 12 connected to the frame.

20. A hydraulic crimping tool as in claim 19 wherein the hydraulic drive section comprises a ram with a roller assembly mounted to a front end of the ram.

21. A hydraulic crimping tool as in claim 20 wherein the jaw assembly comprises means for removably mounting the jaw assembly to frame, and wherein the means for removably mounting comprises the pivot pin located in pivot holes of the jaws and pivotably connecting the jaws to each other.

22. A hydraulic crimping tool as in claim 21 wherein the jaws are substantially identical to each other.

23. A hydraulic crimping tool as in claim 20 wherein the jaw assembly comprises means for preventing rotation of the jaw assembly on the frame, wherein the means for preventing rotation comprises concave surfaces on rear ends of the jaws which are contacted by rollers of the roller assembly.

24. A jaw assembly comprising:

a first jaw having a first pivot section comprising two spaced first ears having pivot pin holes through the first ears;

a second jaw having a second pivot section comprising two spaced second ears having pivot pin holes through the second ears; and a pivot pin located in the pivot pin holes to pivotably mount the first and second jaws to each other, wherein at least one of the pivot sections comprises a guide surface configured to guide alignment of the ears relative to each other to thereby axially align the pivot pin holes with each other before full insertion of the pivot pin into all of the pivot pin holes, wherein the guide surface comprises, at an exterior facing side of the at least one pivot section, a laterally outward extending surface generally facing the pivot pin holes, wherein the jaws each comprise a rear end with a roller contact surface configured to be moved apart by rollers of a roller assembly of a hydraulic crimping tool, wherein the rear ends each comprise a concave surface configured to locate one of the rollers therein at an open jaw position of the jaws.

25. A jaw assembly as in claim 24 wherein the guide surface comprises a plurality of guide pins on the exterior facing side of the at least one pivot section.

26. A jaw assembly as in claim 24 wherein the guide surface comprises a curved guide rib on the exterior facing side of the at least one pivot section.

27. A jaw assembly as in claim 24 wherein the guide surface comprises a curved machined surface pocket adjacent the exterior facing side of at least one pivot section.

28. A jaw assembly as in claim 24 wherein the first and second jaws are substantially identical to each other.

* * * * *